US009909435B2

(12) United States Patent
Propheter-Hinckley

(10) Patent No.: US 9,909,435 B2
(45) **Date of Patent: *Mar. 6, 2018**

(54) TURBINE ENGINE VARIABLE AREA VANE WITH FEATHER SEAL

(71) Applicant: United Technologies Corporation, Hartford, CT (US)

(72) Inventor: Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 269 days.

This patent is subject to a terminal disclaimer.

(21) Appl. No.: 14/789,573

(22) Filed: Jul. 1, 2015

(65) Prior Publication Data

US 2015/0300186 A1 Oct. 22, 2015

Related U.S. Application Data

(63) Continuation of application No. 13/531,033, filed on Jun. 22, 2012, now Pat. No. 9,103,222.

(51) Int. Cl.

| | |
|---|---|
| ***F01D 11/00*** | (2006.01) |
| ***F01D 17/16*** | (2006.01) |
| ***F01D 9/04*** | (2006.01) |

(52) U.S. Cl.

CPC ..... *F01D 9/041* (2013.01); *F01D 11/001* (2013.01); *F01D 11/003* (2013.01); *F01D 17/162* (2013.01); *F05D 2220/30* (2013.01); *F05D 2240/12* (2013.01); *F05D 2240/55* (2013.01)

(58) Field of Classification Search

CPC .... F01D 11/001; F01D 11/003; F01D 11/005; F01D 17/16; F01D 17/162; F01D 9/041; F01D 9/042; F04D 29/563; F04D 29/146; F04D 29/462; F05B 2240/572; F05D 2240/55; F05D 2240/57

See application file for complete search history.

(56) References Cited

U.S. PATENT DOCUMENTS

| | | | |
|---|---|---|---|
| 4,314,791 | A | 2/1982 | Weiler |
| 6,210,106 | B1 | 4/2001 | Hawkins |
| 7,845,906 | B2 | 12/2010 | Spangler et al. |
| 7,857,588 | B2 | 12/2010 | Propheter-Hinckley et al. |
| 8,007,229 | B2 | 8/2011 | McCaffrey et al. |
| 8,105,019 | B2 | 1/2012 | McCaffrey et al. |
| 8,182,208 | B2 | 3/2012 | Bridges, Jr. et al. |
| 8,171,978 | B2 | 5/2012 | Propheter-Hinckley et al. |
| 9,103,222 | B2 * | 8/2015 | Propheter-Hinckley F01D 11/001 |

(Continued)

*Primary Examiner* — Christopher Verdier
(74) *Attorney, Agent, or Firm* — O'Shea Getz P.C.

(57) ABSTRACT

An apparatus for sealing a gap between a stator vane platform including a seal slot, and a rotatable stator vane including a shaft connected to a vane end. The apparatus includes a substantially flat, semi-annular seal body, a first tab and a second tab. The seal body extends circumferentially between a first body end and a second body end, and radially between a radial inner body side and a radial outer body side. The inner body side wraps partially around the shaft, and the outer body side mates with the seal slot. The first tab extends axially from the first body end, and the second tab extends axially from the second body end. The first tab and the second tab engage the vane end and cause the seal body to move within the seal slot during rotation of the stator vane.

18 Claims, 4 Drawing Sheets

(56) References Cited

U.S. PATENT DOCUMENTS

| | | | | |
|---|---|---|---|---|
| 2004/0081554 | A1* | 4/2004 | Bruce | F01D 17/162 415/160 |
| 2009/0097966 | A1 | 4/2009 | McCaffrey | |
| 2009/0148282 | A1* | 6/2009 | McCaffrey | F02C 9/22 415/208.2 |
| 2011/0262274 | A1 | 10/2011 | Boy et al. | |

* cited by examiner

TURBINE ENGINE VARIABLE AREA VANE WITH FEATHER SEAL

CROSS-REFERENCE TO RELATED APPLICATION

This application is a continuation of U.S. patent application Ser. No. 13/531,033 filed Jun. 22, 2012, now U.S. Pat. No. 9,103,222.

STATEMENT REGARDING FEDERALLY SPONSORED RESEARCH OR DEVELOPMENT

This invention was made with government support under Contract No. FA8650-09-D-2923-DO 0013 awarded by the United States Air Force. The government may have certain rights in the invention.

BACKGROUND OF THE INVENTION

1. Technical Field

The present invention relates generally to a turbine engine and, more particularly, to a variable area vane arrangement for a turbine engine.

2. Background Information

A typical turbine engine includes a plurality of engine sections such as, for example, a fan section, a compressor section, a combustor section and a turbine section. One or more of the engine sections may include a variable area vane arrangement. Such a vane arrangement may be configured to guide and/or adjust flow of core gas between adjacent rotor stages within the respective engine section. Alternatively, the vane arrangement may be configured to guide and/or adjust flow of core gas between the respective engine section and an adjacent (e.g., downstream) engine section.

A typical variable area vane arrangement includes a plurality of rotatable stator vanes extending between an outer radial stator vane platform and an inner radial stator vane platform. Outer radial ends of the stator vanes are rotatably connected to the outer radial stator vane platform. Inner radial ends of the stator vanes are rotatably connected to the inner radial stator vane platform. These rotatable connections between the stator vanes and the stator vane platforms may be difficult and expensive to seal. Gas leakage through the rotatable connections may reduce engine efficiency as well as life span of various engine components.

SUMMARY OF THE DISCLOSURE

According to an aspect of the invention, an apparatus is provided for sealing a gap between a stator vane platform including a seal slot, and a rotatable stator vane including a shaft connected to a vane end. The apparatus includes a substantially flat, semi-annular seal body, a first tab and a second tab. The seal body extends circumferentially between a first body end and a second body end, and radially between a radial inner body side and a radial outer body side. The inner body side wraps partially around the shaft, and the outer body side mates with the seal slot. The first tab extends axially from the first body end, and the second tab extends axially from the second body end. The first tab and the second tab engage the vane end and cause the seal body to move within the seal slot during rotation of the stator vane.

According to another aspect of the invention, a variable area vane arrangement is provided that includes a stator vane first platform, a stator vane second platform, a rotatable stator vane, and a seal. The second platform includes a vane aperture and a seal slot disposed in a sidewall of the vane aperture. The rotatable stator vane includes a vane airfoil extending between the first platform and the second platform, a flange connected to an end of the vane airfoil and seated within the vane aperture, and a shaft connected to the end of the vane airfoil adjacent the flange. The seal includes a semi-annular seal body, a first tab and a second tab. The seal body extends circumferentially between a first body end and a second body end, and radially between a radial inner body side and a radial outer body side. The inner body side wraps partially around the shaft, and the outer body side is mated with the seal slot. The first tab extends axially from the first body end. The second tab extends axially from the second body end. The first tab and the second tab engage the flange and cause the seal body to move within the seal slot during rotation of the stator vane.

In some embodiments, the shaft includes a notch with a semi-annular seal surface, and the seal body extends axially between a first body surface and a second body surface that engages the seal surface.

In some embodiments, the seal body, the first tab and the second tab are constructed from a sheet of metal.

In some embodiments, the first tab and the second tab are substantially perpendicular to the seal body.

In some embodiments, the first tab includes a first base tab segment extending axially from the first body end to a first support tab segment, which extends axially back towards the seal body. The second tab includes a second base tab segment extending axially from the second body end to a second support tab segment, which extends axially back towards the seal body. The distal first tab end of the first support tab segment may be connected to the seal body, and a distal second tab end of the second support tab may be connected to the seal body. The first base tab segment and the second base tab segment may be substantially perpendicular to the seal body. The first support tab segment may be angularly offset from the first base tab segment, and the second support tab segment may be angularly offset from the second base tab segment.

In some embodiments, the first support tab segment is angularly offset from the first base tab segment, and the second support tab segment is angularly offset from the second base tab segment.

In some embodiments, the stator vane is a turbine section rotatable stator vane of a turbine engine. In other embodiments, the stator vane is a compressor section rotatable stator vane of a turbine engine.

In some embodiments, the variable area vane arrangement also includes a fixed stator vane connected between the first platform and the second platform.

In some embodiments, the first platform is one of a plurality of arcuate segments of an annular stator vane first platform. The second platform is one of a plurality of arcuate segments of an annular stator vane second platform. The stator vane is one of a plurality of rotatable stator vanes extending between the annular stator vane first platform and the annular stator vane second platform. The seal is one of a plurality of seals, each of which seals a gap between the annular stator vane first platform and a respective one of the plurality of rotatable stator vanes.

The foregoing features and the operation of the invention will become more apparent in light of the following description and the accompanying drawings.

DETAILED DESCRIPTION OF THE INVENTION

Figure 1:
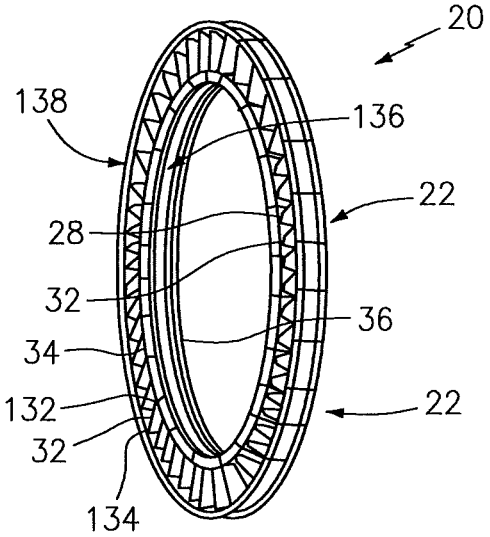
FIG. 1 is a perspective illustration of a variable area vane arrangement for a turbine engine.
Figure 2:
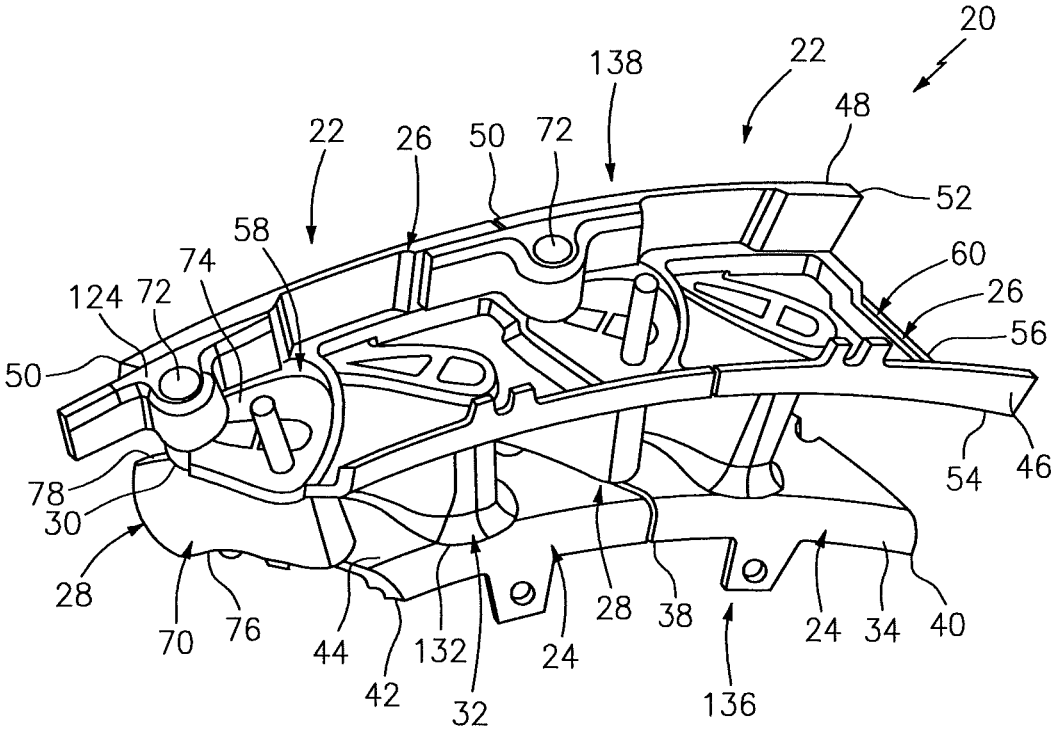
FIG. 2 is a perspective illustration of a section of the vane arrangement of FIG. 1.

FIG. 1 illustrates a variable area vane arrangement 20 for an engine section (e.g., a turbine section and/or a compressor section) of a turbine engine. FIG. 2 illustrates an enlarged section of the vane arrangement 20. Referring to FIGS. 1 and 2, the vane arrangement 20 may include a plurality of vane arrangement segments 22.

Referring to FIG. 2, one or more of the vane arrangement segments 22 includes a stator vane first platform 24 (e.g., an inner platform), a stator vane second platform 26 (e.g., an outer platform), at least one rotatable stator vane 28, and an apparatus 30 (e.g., a rotatable feather seal) for sealing a gap between the second platform 26 and the rotatable stator vane 28. The vane arrangement segment 22 may also include at least one fixed stator vane 32.

The first platform 24 extends longitudinally between a first (e.g., upstream) platform end 34 and a second (e.g., downstream) platform end 36 (see FIG. 1). The first platform 24 extends laterally and, for example, arcuately between a first platform side 38 and a second platform side 40. The first platform 24 also extends between a first (e.g., inner) platform surface 42 and a second (e.g., outer, gas path) platform surface 44.

The second platform 26 extends longitudinally between a first (e.g., upstream) platform end 46 and a second (e.g., downstream) platform end 48. The second platform 26 extends laterally and, for example, arcuately between a first platform side 50 and a second platform side 52. The second platform 26 also extends between a first (e.g., inner, gas path) platform surface 54 and a second (e.g., outer) platform surface 56.

Figure 3:
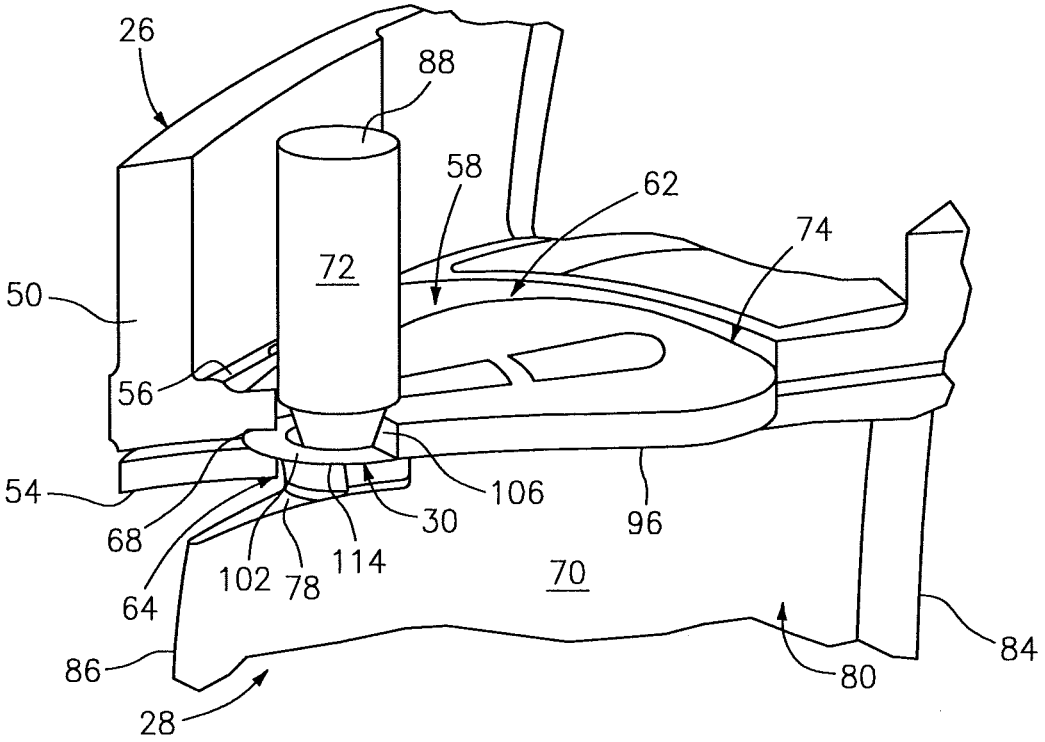
FIG. 3 is another perspective illustration of a section of the vane arrangement of FIG. 1.
Figure 4:
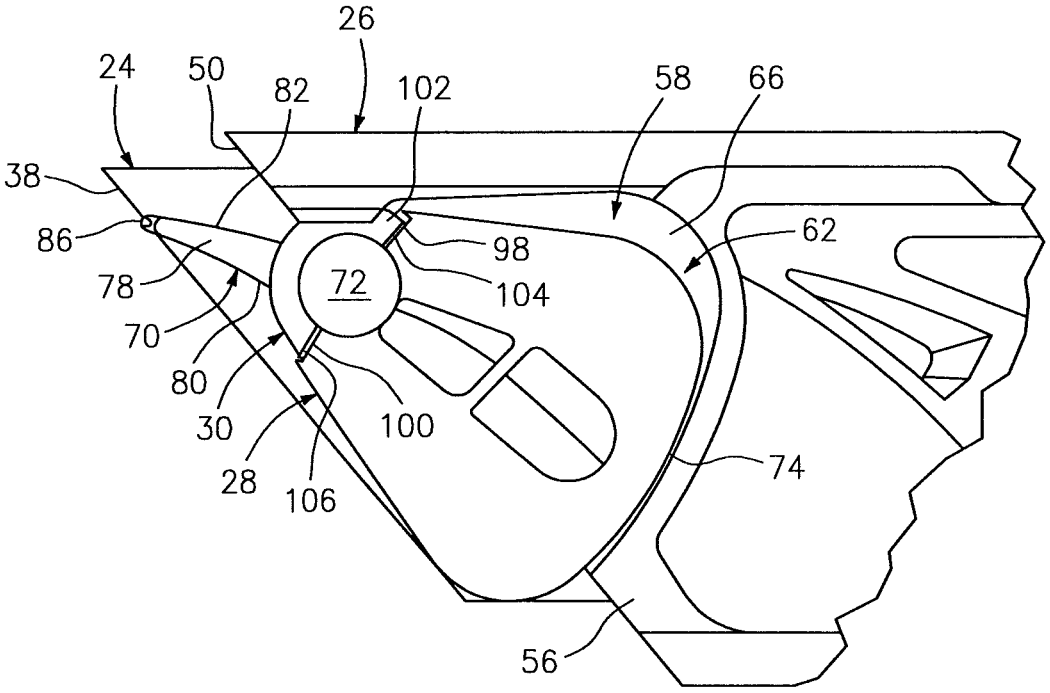
FIG. 4 is a top view illustration of a section of the vane arrangement of FIG. 3.

The second platform 26 includes one or more vane apertures such as, for example, a first vane aperture 58 and a second vane aperture 60. The first vane aperture 58 may be located at the first platform side 50, and the second vane aperture 60 may be located at the second platform side 52. Each of the vane apertures 58, 60 extends from the second platform surface 56 towards (e.g., to) the first platform surface 54. Referring to FIGS. 3 and 4, for example, the first vane aperture 58 may include a first aperture segment 62, a second aperture segment 64, an aperture shelf 66 with a substantially flat sealing surface, and a seal slot 68 (e.g., a feather seal slot). The first aperture segment 62 extends from the second platform surface 56 to the second aperture segment 64, which extends to the first platform surface 54. The aperture shelf 66 is defined at the intersection of the first aperture segment 62 and the second aperture segment 64. The seal slot 68 extends into a sidewall of the first vane aperture 58 and, for example, is axially aligned with the aperture shelf 66. The second vane aperture 60 (see FIG. 2) may have a similar configuration to that of the first vane aperture 58. The second vane aperture 60, for example, may include a first aperture segment, a second aperture segment, an aperture shelf with a substantially flat sealing surface, and a seal slot (e.g., a feather seal slot).

The rotatable stator vane 28 includes a rotatable vane airfoil 70, a shaft 72 and a flange 74. Referring to FIG. 2, the rotatable vane airfoil 70 extends axially between a first (e.g., inner) airfoil end 76 and a second (e.g., outer) airfoil end 78. Referring now to FIGS. 3 and 4, the rotatable vane airfoil 70 includes a concave airfoil surface 80 and a convex airfoil surface 82, where both surfaces extend between an airfoil leading edge 84 and an airfoil trailing edge 86.

Figure 5:
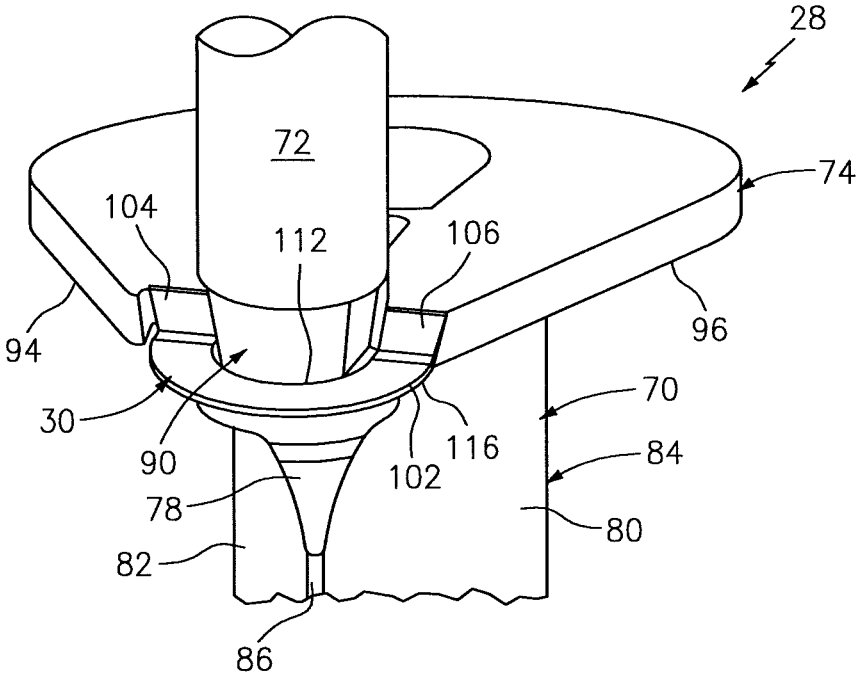
FIG. 5 is a perspective illustration of a section of a rotatable stator vane and a seal.
Figure 6:
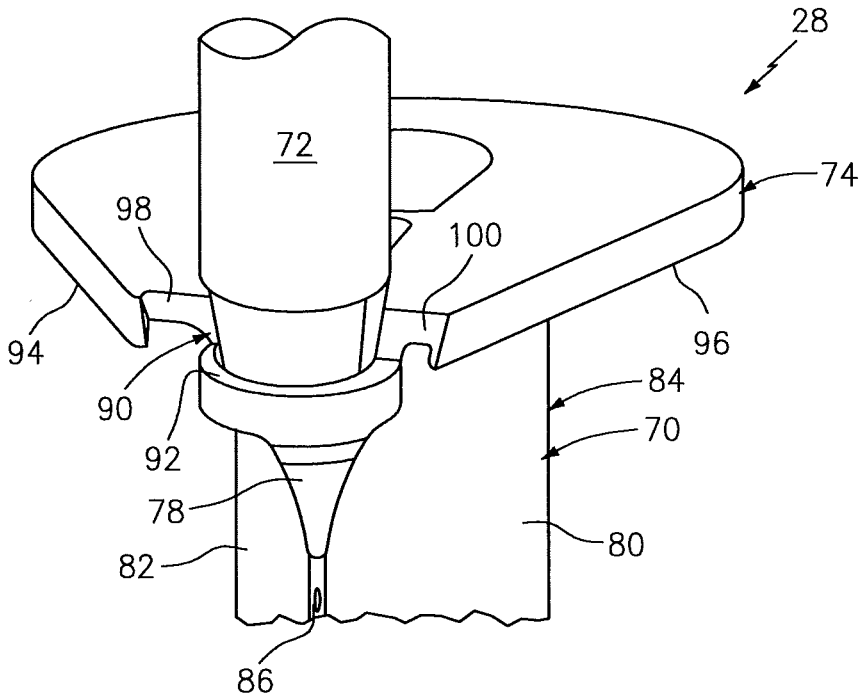
FIG. 6 is a perspective illustration of a section of the rotatable stator vane of FIG. 5.

Referring to FIGS. 3 to 6, the shaft 72 is connected to the second airfoil end 78, and extends axially to a distal shaft end 88. The shaft 72 is located a first distance from the airfoil leading edge 84. The shaft 72 is located a second distance from the airfoil trailing edge 86 that is, for example, less than the first distance. Referring to FIGS. 5 and 6, the shaft 72 may include a circumferentially extending notch 90 with a semi-annular seal surface 92.

The flange 74 is connected to the second airfoil end 78, for example, adjacent the shaft 72 and axially aligned with the notch 90. The flange 74 extends radially out from the shaft 72, for example, towards the airfoil leading edge 84 and/or away from the concave airfoil surface 80 and/or the convex airfoil surface 82. The flange 74 includes one or more (e.g., axially extending) tab seal surfaces 98 and 100, which are located on opposite sides of the shaft 72. The flange 74 may also include one or more (e.g., radially extending) platform seal surfaces 94 and 96, which are located on opposite sides of the rotatable vane airfoil 70.

Figure 7:
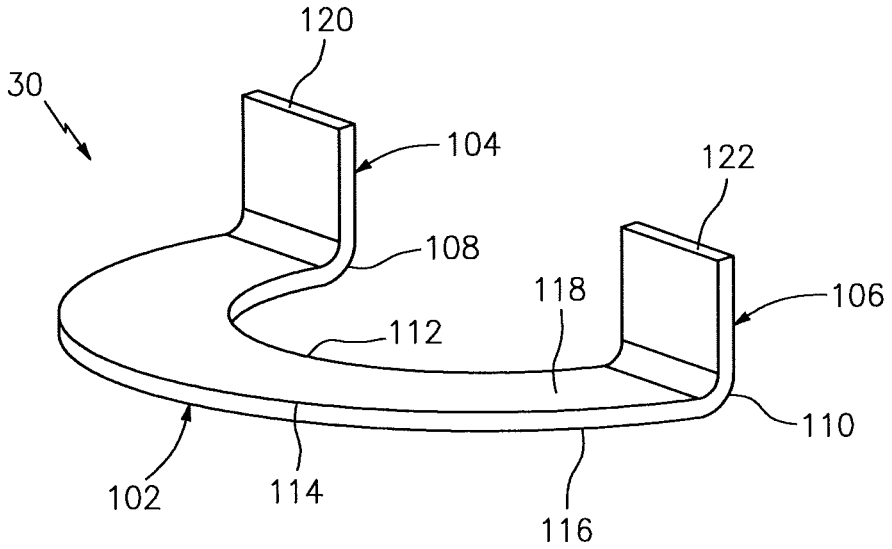
FIG. 7 is a perspective illustration of the seal of FIG. 5.

Referring to FIG. 7, the seal 30 includes a substantially flat, semi-annular seal body 102, a first tab 104 and a second tab 106. The seal body 102 extends circumferentially, between approximately zero and two hundred degrees (e.g., about 180°), from a first body end 108 to a second body end 110. The seal body 102 extends radially between a radial inner body side 112 and a radial outer body side 114. The seal body 102 also extends axially between a first body surface 116 and a second body surface 118. The first tab 104 extends axially (e.g., perpendicularly) from the second body surface 118 at the first body end 108 to a distal first tab end 120. The second tab 106 extends axially (e.g., perpendicularly) from the second body surface 118 at the second body end 110 to a distal second tab end 122.

Referring to FIGS. 5 and 6, the first tab 104 engages (e.g., sealingly connects to) the first tab seal surface 98. The second tab 106 engages (e.g., sealingly connects to) the second tab seal surface 100. The inner body side 112 wraps partially around the shaft 72. The first body surface 116 engages (e.g., sealingly connects to) the semi-annular seal surface 92.

Referring to FIGS. 3 and 4, the rotatable stator vane 28 is mated with the first vane aperture 58. The flange 74, for example, is seated in the first aperture segment 62 and the first platform seal surface 94 (see FIGS. 5 and 6) engages (e.g., sealingly connects to) the sealing surface of the aperture shelf 66. The outer body side 114 is mated with (e.g., sealingly inserted into) the seal slot 68 to form a seal therebetween.

Figure 8:
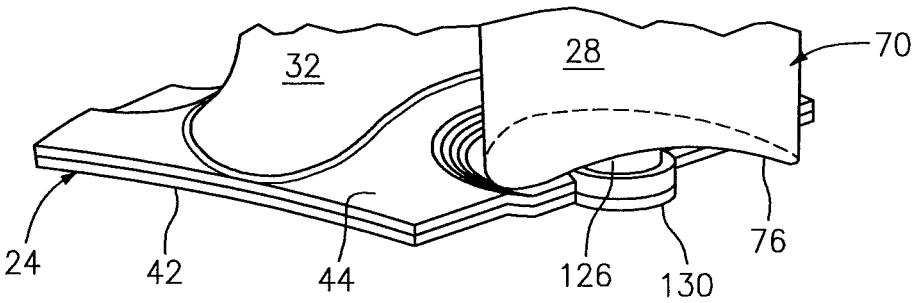
FIG. 8 is another perspective illustration of a section of the vane arrangement of FIG. 1.

Referring to FIG. 2, the rotatable vane airfoil 70 extends between and is rotatably connected to the first platform 24 and the second platform 26. The shaft 72, for example, is rotatably connected to the second platform 26 by a bearing 124 (e.g., a pillow block bearing, etc.). Referring to FIG. 8, a second shaft 126 connected to the first airfoil end 76 may be rotatably connected to the first platform 24 by a bearing 130 (e.g., a cartridge bearing, etc.). Examples of such rotatable connections are disclosed in U.S. Publication No. 2009/0097966, which is hereby incorporated by reference, and assigned to the assignee of the present invention. Examples of other types of rotatable connections are disclosed in U.S. Pat. Nos. 8,105,019 and 8,007,229, each of which is hereby incorporated by reference, and assigned to the assignee of the present invention. The present invention, of course, is not limited to any particular rotatable connection types and/or configurations between the rotatable stator vane and the first and second platforms.

Referring to FIGS. 1 and 2, the fixed stator vane 32 includes a fixed vane airfoil that extends axially between a first (e.g., inner) airfoil end 132 and a second (e.g., outer) airfoil end 134. The fixed vane airfoil includes a concave airfoil surface and a convex airfoil surface, where both surfaces extend between an airfoil leading edge and an airfoil trailing edge (not shown). The first airfoil end 132 is fixedly connected to (e.g., integral with) the second platform surface 44 of the first platform 24. The second airfoil end 134 is fixedly connected to (e.g., integral with) the first platform surface 54 of the second platform 26.

Each of the vane arrangement segments 22 is connected between two respective other vane arrangement segments 22 to form the variable area vane arrangement 20. The first platform end 38 of each of the first platforms 24, for example, is connected to a respective second platform end 40 to form an annular stator vane first platform 136. Each of the rotatable stator vanes 28 is mated with a respective second vane aperture 60, for example, in a similar manner as described above with respect to the mating of the rotatable stator vane 28 with the first vane aperture 58. The first platform end 50 of each of the second platforms 26 is connected to a respective second platform end 52 to form an annular stator vane second platform 138.

The variable area vane arrangement 20 may be arranged, in some embodiments, between adjacent rotor stages (e.g., adjacent turbine or compressor stages) of the engine section. The variable area vane arrangement 20 may be arranged, in other embodiments, within the respective engine section adjacent another (e.g., downstream) engine section.

The rotatable stator vanes 28 may be respectively rotated about axes of the shafts 72 to guide gas through the variable area vane arrangement 20 according to a certain trajectory. The rotatable stator vanes 28 may also or alternatively be rotated to adjust flow of the gas through the variable area vane arrangement 20. Referring to FIGS. 3 and 4, each of the seals 30 moves with the respective rotatable stator vane 28 during the rotation. When the rotatable stator vane 28 moves counter-clockwise, for example, the first tab seal surface 98 pushes against the first tab 104, which causes the seal 30 to move counter-clockwise about the shaft 72. When the rotatable stator vane 28 moves clockwise, for example, the second tab seal surface 100 pushes against the second tab 106, which causes the seal 30 to move clockwise about the shaft 72. As the seal 30 rotates about the shaft 72, the seal body 102 may maintain the seals with the semi-annular seal surface 92 (see FIG. 6) and the seal slot 68, and the tabs 104 and 106 may maintain the seals with the tab seal surfaces 98 and 100. In this manner, the seal 30 may significantly reduce and/or eliminate gas leakage through the gap between the rotatable stator vane 28 and the annular stator vane second platform 138 (see FIG. 2) during the rotation of the respective vane 28.

In some embodiments, the seal 30 may be constructed (e.g., cut and bent) from a flat substrate (e.g., sheet metal) such that the first tab 104 and the second tab 106 are integral with the seal body 102. The present invention, however, is not limited to any particular seal construction and/or materials. In other embodiments, for example, the seal 30 may be constructed (e.g., machined, milled, etc.) from a metal or non-metal ingot. In still other embodiments, separate seal components may be connected together to construct the seal 30; e.g., the tabs 104 and 106 may be welded, braised or otherwise adhered to the seal body 102.

Figure 9:
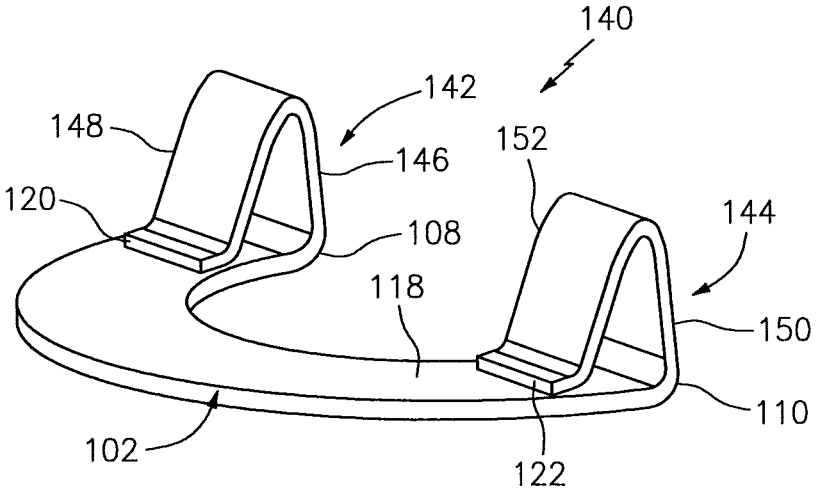
FIG. 9 is a perspective illustration of an alternative embodiment seal.

FIG. 9 illustrates an alternative embodiment apparatus 140 (e.g., a rotatable feather seal) for sealing the gap between the second platform 26 and the rotatable stator vane 28 of FIG. 2. In contrast to the seal 30 of FIG. 7, the seal 140 includes an alternative embodiment first tab 142 and an alternative embodiment second tab 144.

The first tab 142 includes a first base tab segment 146 and a first support tab segment 148. The first base tab segment 146 extends axially (e.g., perpendicularly) from the second body surface 118 at the first body end 108 to the first support tab segment 148, which extends axially back towards the second body surface 118 to the distal first tab end 120. The first support tab segment 148 may be offset from the first base tab segment 146 by a first angle (e.g., between 0 and 45 degrees), and offset from the second body surface 118 by a second angle (e.g., between 45 and 90 degrees). In some embodiments, the first tab end 120 is connected (e.g., welded, braised, or otherwise adhered) to the seal body 102. In other embodiments, the first tab end 120 may move relative to the seal body 102.

The second tab 144 includes a second base tab segment 150 and a second support tab segment 152. The second base tab segment 150 extends axially (e.g., perpendicularly) from the second body surface 118 at the second body end 110 to the second support tab segment 152, which extends axially back towards the second body surface 118 to the distal second tab end 122. The second support tab segment 152 may be offset from the second base tab segment 150 by the first angle, and offset from the second body surface 118 by the second angle. In some embodiments, the second tab end 122 is connected (e.g., welded, braised, or otherwise adhered) to the seal body 102. In other embodiments, the second tab end 122 may move relative to the seal body 102.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents

What is claimed is:

1. An apparatus for sealing a gap between a stator vane platform comprising a seal slot, and a rotatable stator vane comprising a shaft connected to a vane end, the apparatus comprising:

a seal body extending circumferentially between a first body end and a second body end, and radially between a radial inner body side and a radial outer body side;

wherein the inner body side is configured to wrap partially around the shaft;

wherein the outer body side is configured to mate with the seal slot;

wherein the apparatus is configured to engage with the stator vane such that the seal body moves with the stator vane and within the seal slot during rotation of the stator vane; and wherein the first body end and the second body end are configured to engage the vane end and cause the seal body to move within the seal slot during rotation of the stator vane.

2. The apparatus of claim 1, wherein the seal body is a semi-annular seal body.

3. The apparatus of claim 1, further comprising a first tab extending axially from the first body end, and a second tab extending axially from the second body end.

4. The apparatus of claim 3, wherein the seal body, the first tab and the second tab are constructed from a sheet of metal.

5. The apparatus of claim 3, wherein the first tab and the second tab are substantially perpendicular to the seal body.

6. The apparatus of claim 3, wherein the first tab comprises a first base tab segment extending axially from the first body end to a first support tab segment, which extends axially back towards the seal body; and the second tab comprises a second base tab segment extending axially from the second body end to a second support tab segment, which extends axially back towards the seal body.

7. The apparatus of claim 6, wherein a distal first tab end of the first support tab segment is connected to the seal body, and a distal second tab end of the second support tab is connected to the seal body.

8. The apparatus of claim 6, wherein the first base tab segment and the second base tab segment are substantially perpendicular to the seal body.

9. The apparatus of claim 6, wherein the first support tab segment is angularly offset from the first base tab segment, and the second support tab segment is angularly offset from the second base tab segment.

10. The apparatus of claim 1, wherein the seal body is substantially flat.

11. A variable area vane arrangement, comprising:

a stator vane first platform;

a stator vane second platform comprising a vane aperture and a seal slot;

a rotatable stator vane comprising a vane airfoil extending between the first platform and the second platform, a flange connected to an end of the vane airfoil and seated within the vane aperture, and a shaft connected to the end of the vane airfoil adjacent the flange; and a seal comprising a seal body extending circumferentially between a first body end and a second body end, and radially between a radial inner body side and a radial outer body side, wherein the inner body side wraps partially around the shaft, and the outer body side is mated with the seal slot;

wherein the seal is configured to engage with the stator vane such that the seal body moves with the stator vane and within the seal slot during rotation of the stator vane; and wherein the shaft comprises a notch with a semi-annular seal surface, and the seal body extends axially between a first body surface and a second body surface that engages the seal surface.

12. The arrangement of claim 11, wherein the seal seals a gap between the second stator vane platform and the stator vane.

13. The arrangement of claim 11, wherein the seal body is constructed from sheet metal.

14. The arrangement of claim 11, wherein the stator vane comprises a turbine section rotatable stator vane of a turbine engine.

15. The arrangement of claim 11, further comprising a fixed stator vane connected between the first platform and the second platform.

16. The arrangement of claim 11, wherein the first platform is one of a plurality of arcuate segments of an annular stator vane first platform;

the second platform is one of a plurality of arcuate segments of an annular stator vane second platform;

the stator vane is one of a plurality of rotatable stator vanes extending between the annular stator vane first platform and the annular stator vane second platform; and the seal is one of a plurality of seals, each of which seals a gap between the annular stator vane first platform and a respective one of the plurality of rotatable stator vanes.

17. The arrangement of claim 11, wherein the seal slot is disposed in a sidewall of the vane aperture.

18. A variable area vane arrangement, comprising:

a stator vane first platform;

a stator vane second platform comprising a vane aperture and a seal slot;

a rotatable stator vane comprising a vane airfoil extending between the first platform and the second platform, a flange connected to an end of the vane airfoil and seated within the vane aperture, and a shaft connected to the end of the vane airfoil adjacent the flange; and a seal comprising a seal body extending circumferentially between a first body end and a second body end, and radially between a radial inner body side and a radial outer body side, wherein the inner body side wraps partially around the shaft, and the outer body side is mated with the seal slot;

wherein the seal is configured to engage with the stator vane such that the seal body moves with the stator vane and within the seal slot during rotation of the stator vane;

wherein the seal includes a first tab extending axially from the first body end, and a second tab extending axially from the second body end; and wherein the first tab and the second tab engage the flange and cause the seal body to move within the seal slot during rotation of the stator vane.

* * * * *